US007774880B1

(12) United States Patent
Botts

(10) Patent No.: US 7,774,880 B1
(45) Date of Patent: Aug. 17, 2010

(54) STADIUM SEAT CUSHION

(76) Inventor: Veronica A. Botts, 201 Sunrise Ave, New Cumberland, PA (US) 17070

( * ) Notice: Subject to any disclaimer, the term of this patent is extended or adjusted under 35 U.S.C. 154(b) by 0 days.

(21) Appl. No.: 12/017,121

(22) Filed: Jan. 21, 2008

(51) Int. Cl.
*B68G 5/00* (2006.01)

(52) U.S. Cl. ..... 5/656; 5/653; 297/228.1

(58) Field of Classification Search ..... 5/653, 5/655, 656, 420; 297/180.12, 228.1
See application file for complete search history.

(56) References Cited

U.S. PATENT DOCUMENTS

| | | | | |
|---|---|---|---|---|
| 4,604,987 | A * | 8/1986 | Keltner | 126/204 |
| 5,533,219 | A * | 7/1996 | Meyers | 5/653 |
| 6,079,599 | A * | 6/2000 | Nordstrom et al. | 224/153 |
| 6,588,840 | B1 * | 7/2003 | Lombardo | 297/228.12 |
| 7,232,184 | B2 * | 6/2007 | Lawler | 297/228.1 |
| 7,316,452 | B2 | 1/2008 | Vestweber | |

OTHER PUBLICATIONS

Bleacher Seats, http://www/weplay.com/bleacher/seats, visited Jan. 9, 2008, 1 page.
Portable Folding Floor Chairs—Howdaseat X-Large Portable Seat Chair Shop, Find and Buy At Comfortchannel.com, http://www.comfortchannel.com/prod.itml/icOid/9662, visited Jan. 9, 2008, 1 page.
Stadium Seat, http://www.weplay.com/stadium/seat, visited Jan. 9, 2008, 1 page.
Bleacher Seats—GCI Outdoor—Folding Stadium Seats, Portable Stadium Chairs, Sports Seats, http://www.gcioutdoor.com/products_bleacherback.htm, visited Jan. 9, 2008, 1 page.
Image: Skwoosh Stadium Gel Seat—Black, http://www.amazon.com/gp/product/images/B000AGCHPK/sr=8-1/qid=1199901065/ref=dp_otherviews_..., visited Jan. 9, 2008, 1 page.
Amazon.com: Cordless Heated Seat Cushion: Automotive, http://www.amazon.com/Cordless-Heated-Seat-Cushion/dp/B000XQ6M5S/ref=sr_1_9?ie=UTF8&s=automotive@qid=1199901191&sr=8-9, visited Jan. 9, 2008, 2 page.
Image: Vesture 110.92.14042 Microcore Lava Buns Heated Seat Cushion—Black, http://www.amazon.com/gp/product/images/B000KU573K/sr=8-13/qid=1199901191/ref=dp_image_text_..., visited Jan. 9, 2008, 1 page.
Bleacher and Seat Cushions for Sporting Events—Air Filled_Roho, http://www.shapefitting.com/category.aspx?categoryID=53, visited Jan. 9, 2008, 1 page.
Promotional Item 13.5"x2.5"—Vinyl Square Stadium Cushion, http://promopeddler.com/Detail/88740-VCS14/2.5, visited Jan. 9, 2008, 1 page.

(Continued)

*Primary Examiner*—Robert G Santos
*Assistant Examiner*—Nicholas Polito
(74) *Attorney, Agent, or Firm*—Hooker & Habib, P.C.

(57) ABSTRACT

A seat cushion for an individual stadium seat includes a cushion portion and a pouch on one side of the cushion portion. The pouch receives an end of the seat to secure the cushion to the seat with the cushion portion on the seat. The seat cushion also includes an adjustable length strap that can also secure the cushion to a stadium bench seat or can maintain the cushion in a rolled-up condition for easy carrying or storage.

10 Claims, 4 Drawing Sheets

OTHER PUBLICATIONS

Imprinted Stadium—Stadium Seat Includes: Blanket and Cushion and Backback. Blank Product Only.—53509/SET400-B, http://www.promopeddler.com/Detail/53509/SET400-B?x=69&y=14, visited Jan. 9, 2008, 1 page.

Custom Imprinted Spirit Worx—Square—Standard Stadium Eva Foam Stadium Seat Cushion, www.promopeddler.com/Detail/54886/SC551, visited Jan. 9, 2008, 1 page.

* cited by examiner

STADIUM SEAT CUSHION

FIELD OF THE INVENTION

The invention relates generally to seat cushions, and more specifically to seat cushions for use with individual stadium seats or with stadium bench seats.

BACKGROUND OF THE INVENTION

Many sports stadiums offer individual stadium seats instead of bench seats for fan seating. A conventional stadium seat has a stationary seat back and a folding seat pivotally attached to the seat back. The seat pivots up against the seat back to a raised position when not in use to provide additional aisle space.

The seat is made of a hard rigid material such as molded plastic, wood, or metal, and seats for outdoor use are typically not padded or cushioned. Many fans find such hard stadium seats to be uncomfortable and so place seat cushions over the seats. A seat cushion, however, will often slide off the seat when the seat rises up when the fan stands or leaves the seat temporarily during the game. The fan returns to a soiled or dirty cushion.

Lombardo U.S. Pat. No. 6,588,840 discloses a seat cushion that has a flap extending from one end of the cushion. The flap folds and extends over one side of the seat cushion, defining a gap between the flap and the one side of the seat cushion. Adjustable straps extend from the flap to the seat cushion and define the size of the gap and prevent the flap from falling away from the seat cushion. The pocket receives an end of the stadium seat and prevents the cushion from falling off the seat when the seat is raised.

Although the Lombardo cushion is useful for individual seats or for the ends of bench seats, it cannot be used with interior seating positions along the bench seat. And the construction of some individual seats causes difficulty in extending or fitting straps between the relatively tight spacing between the seat and the sides of the seat that support the arm rests.

Some fans use portable stadium seats rather than seat cushions to improve the comfort of uncushioned stadium seats. A portable stadium seat includes its own cushioned seat and a seat back. The portable seat may prevent the seat from rising when the fan is not seated, but the seat can then obstruct the aisle. A portable seat is also awkward to transport to the stadium, and is also awkward to carry within the stadium where walkways are crowded and space is limited. Portable stadium seats are often not usable with bench seats, limiting their use to only seats with seat backs.

Keltner, U.S. Pat. No. 4,604,987 discloses a seat cushion having a strap that extends around the seat to hold the seat cushion in place on the seat. The Keltner cushion can be used on both individual stadium seats and on bench seats. As previously discussed, however, straps can be difficult to use with some individual stadium seats due to the tight fit between seat components.

Thus there is a need for an improved seat cushion for use both with individual stadium seats and all seating positions of bench seats. The improved seat cushion should not fall off the seat when the seat is not in use, and should be easy to transport to the stadium and to carry within the stadium. The improved seat cushion should also be attachable to individual stadium seats without using straps.

SUMMARY OF THE INVENTION

The invention is an improved seat cushion for use with stadium seats and with all seating positions of bench seats. The seat cushion of the present invention will not fall off the seat when the seat is not in use. The seat cushion is easy to transport to the stadium, and is easy to carry within the stadium.

A seat cushion in accordance with the present invention includes a seat cushion portion, a pouch formed on one side of the cushion portion, and an adjustable length strap attached to the one side or the other side of the cushion.

The pouch receives one end of a stadium seat or an end of a bench seat to secure the seat cushion to the seat without the use of straps. The pouch secures the seat cushion to the stadium seat even when the seat is raised.

The strap attaches the cushion when used with intermediate seating positions of the bench seat. Advantageously the strap is not used when attaching the cushion to an individual stadium seat and does not have to be used when attaching the cushion to an end of a bench seat.

In a preferred embodiment a stretchable fabric forms part of the pouch. The fabric stretches to conform closely to the seat and holds the cushion securely in place on the seat. The fabric enables the seat cushion to be securely held on even curved, "ergonomically designed" seats.

In particularly preferred embodiments an additional pouch is located on the other side of the cushion portion. The additional pouch is sized to hold a preferably noncombustable heating source, such as a body warmer used for arthritis pain relief.

The seat cushion can be rolled up into a roll when not in use for compact transport or storage. The strap attached to the seat cushion can extend around the roll to retain the seat cushion in its rolled-up condition. The strap can also be used to secure the roll to one's belt for hands-free carrying.

The seat cushion of the present invention provides a lightweight, comfortable cushion for use with either stadium seats or all seating positions of bench seats. The seat cushion can be rolled up for compact transport or storage, and can be easily carried in even crowded stadium conditions.

Other objects and features of the present invention will become apparent as the description proceeds, especially when taken in conjunction with the accompanying four drawing sheets illustrating an embodiment of the invention.

DESCRIPTION OF THE PREFERRED EMBODIMENT

Figure 1:
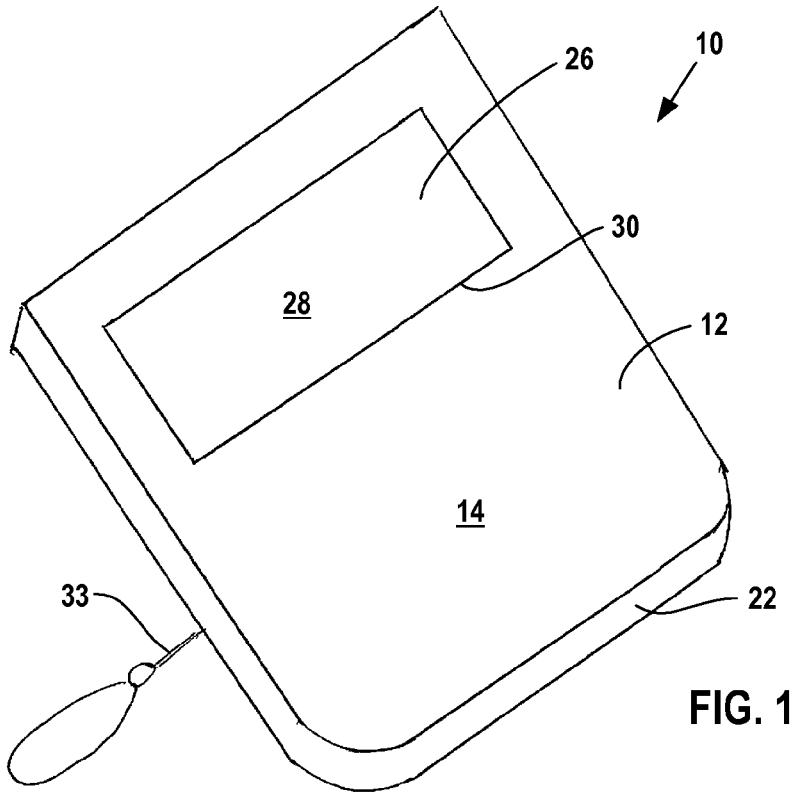
FIG. 1 is a top perspective view of the stadium seat cushion in accordance with the present invention.
Figure 2:
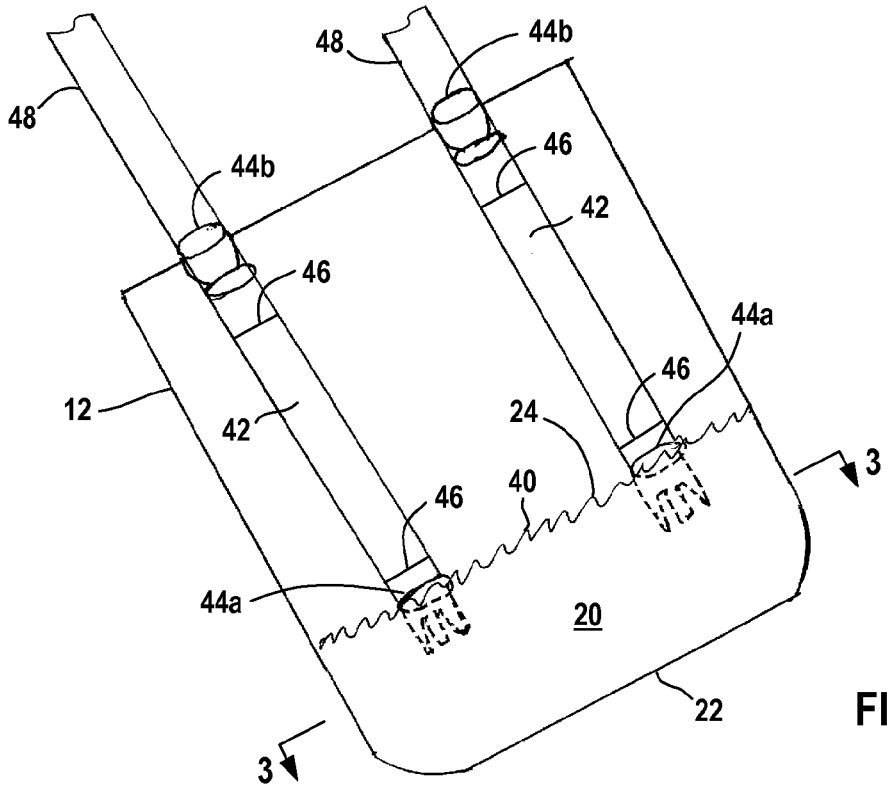
FIG. 2 is a bottom perspective view of the stadium seat cushion.
Figure 3:
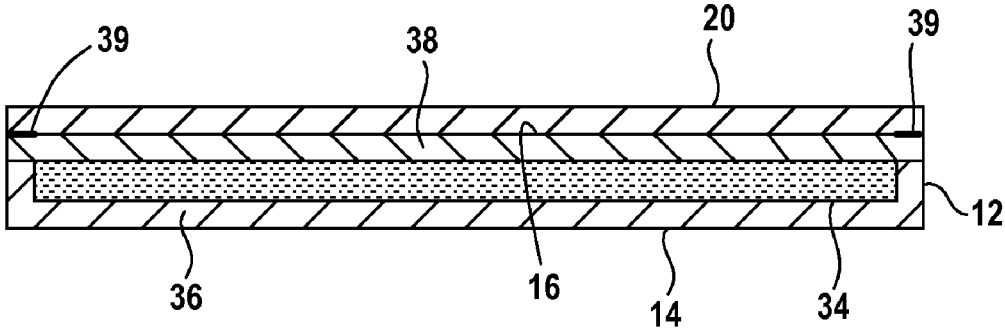
FIG. 3 is a sectional view taken along lines 3-3 of FIG. 2.

FIGS. 1-3 illustrate a stadium seat cushion 10 in accordance with the present invention. Seat cushion 10 includes a cushion portion 12 having opposite top and bottom sides 14, 16 respectively. A pocket or pouch 18 is formed on the bottom side 16 by a stretchable fabric 20 that extends from a front edge 22 of the cushion portion to a pouch opening 24 accessible from the bottom side of the cushion. A second pocket or pouch 26 is formed on the top side 14 by a fabric piece 28 and has a pouch opening 30 accessible from the upper side of the cushion. A pair of like spaced-apart straps 32 is attached to the bottom side of the cushion portion 12. A strap handle 33 (not shown in all the figures) is attached to the side of the cushion 10.

The cushion portion 12 is generally rectangular in shape and is sized to fit on a stadium seat. The illustrated cushion portion 12 is about 16 inches wide and about 18 inches long. The cushion portion 12 includes a cushion body 34 made of ⅝-inch thick flexible closed cell foam. A comfortable fleece cover 36 forms the top side 14 of the cushion portion 12 and a sports nylon fabric cover 38 forms the bottom side 16 of the cushion portion 12. The nylon fabric is preferably waterproof to prevent water absorbing into the cushion if the seat cushion were placed on a wet seat. The thickness of the fabrics used are exaggerated in FIG. 3 for clarity.

Pouch 18 extends the full width of the cushion portion 12 and is formed by stitching three sides of the fabric 20 to the bottom side of the cushion portion 12. Stitching 39 along the edges of the pouch 18 are shown in FIG. 3. The end of the fabric 20 along the pouch opening is hemmed to capture an elastic cord 40 that extends the width of the pouch opening.

Pouch 26 is formed by stitching three sides of the fabric piece 28 to the top side of the cushion portion 12. The illustrated fabric piece 28 is also fleece fabric. The size of the pouch 26 is not critical but is preferably large enough to receive a conventional body warmer packet that can heat the seat cushion. A conventional body warmer packet that has been used with the present invention is about 6 inches by 5 inches in cross section and about an eighth of an inch thick, and generates heat for up to twelve hours.

Each strap 32 includes a length of strap webbing 42 and a conventional side release buckle 44. The webbing 42 is secured to the bottom side of the cushion portion 12 by stitching 46, with a length of webbing 48 that can extend away from the cushion portion 14. The female buckle member 44*a* is attached to one end of the webbing 42 and normally is located in the pouch 18 beneath the fabric 22 when not in use. The male buckle member 44*b* is movable along the webbing length 48 to adjust the length of the strap.

Figure 5:
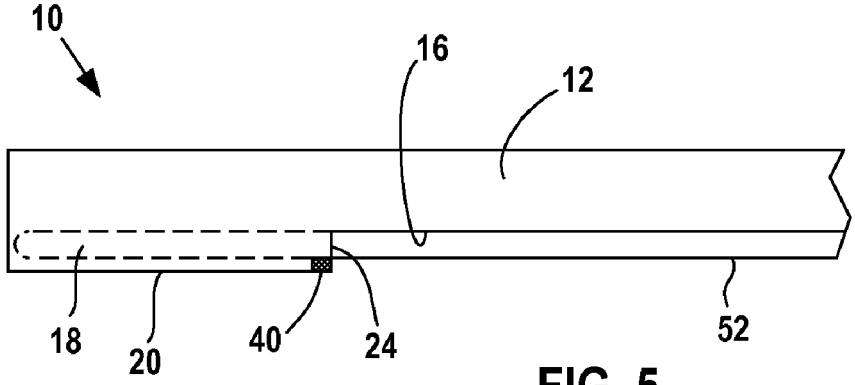
FIG. 5 is a partial side view of a stadium seat cushion on the end of a seat.
Figure 4:
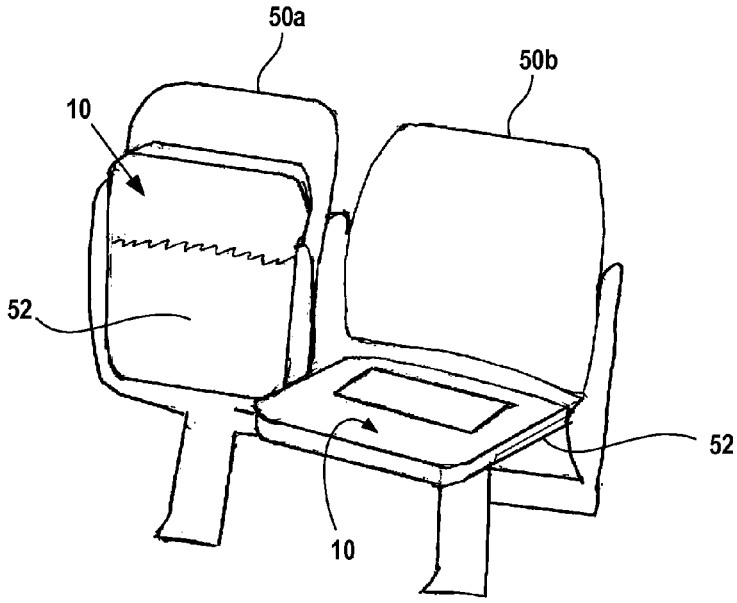
FIG. 4 illustrates stadium seat cushions on two stadium seats, one seat raised and the other seat lowered.

FIG. 4 illustrates a pair of stadium seat cushions 10 on a raised conventional stadium seat 50*a* and a lowered stadium seat 50*b*, each having a foldable seat 52. The buckles 42*a* are removed from the pouch 18 before using a cushion 10 with a seat 50. The end of the seat 52 is inserted into the pouch 18 through the pouch opening 24 to secure the cushion 10 to the seat. See FIG. 5. The pouch 18 and the pouch opening 24 are preferably sized such that the pouch fabric 20 and the elastic cord 40 elastically expand against the seat to tightly fit the seat between the bottom side 16 of the cushion portion 12 and the pouch fabric 20. The cushion portion 12 is on top of the seat, and the straps (not shown) dangle below the seat out of the way. The upper pouch 26 is exposed and can be accessed by the user.

When the seat 52 is raised as shown in FIG. 4, the pouch 18 prevents the seat cushion 10 from sliding off of the seat 52. The seat cushion 10 remains in place.

Figure 6:
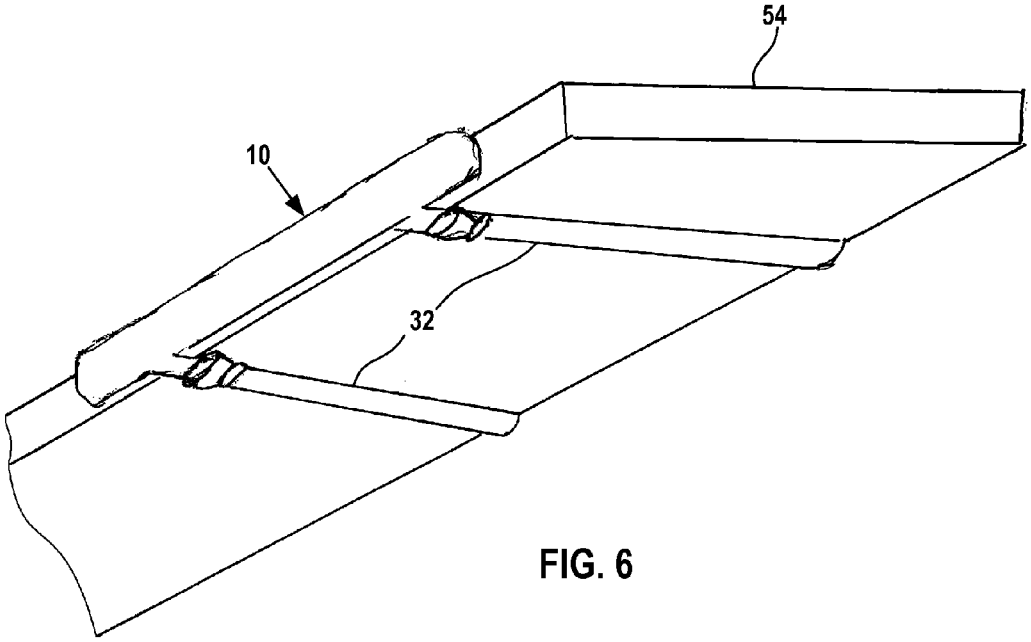
FIG. 6 is a bottom perspective view of a stadium seat cushion on a stadium bench seat.

FIG. 6 illustrates use of the seat cushion 10 on a conventional stadium bench seat 54. The lower side of the seat cushion 10 is placed on the bench seat, and the straps 32 are used to secure the cushion 10 to the bench seat as shown. The length of the straps can be adjusted as necessary to accommodate variations in bench seat dimensions.

Figure 7:
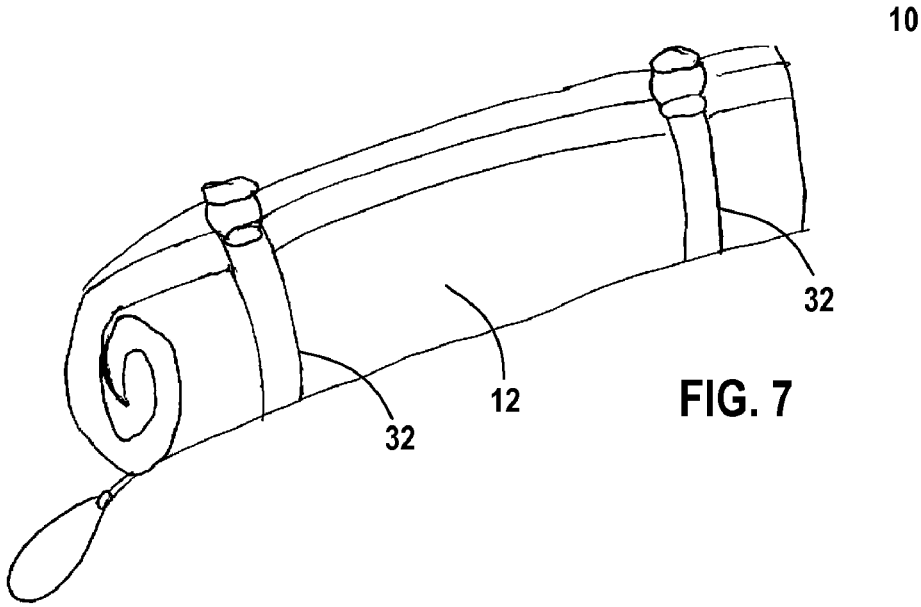
FIG. 7 is a side perspective view of the stadium seat cushion rolled-up for storage or transport.

The seat cushion 10 can be rolled up to form a compact roll shown in FIG. 7. The cushion portion 12 is rolled up with the straps 32 on the outside of the roll. The straps 32 encompass the cushion portion to retain the cushion portion in the rolled-up condition as shown in FIG. 7.

Figure 8:
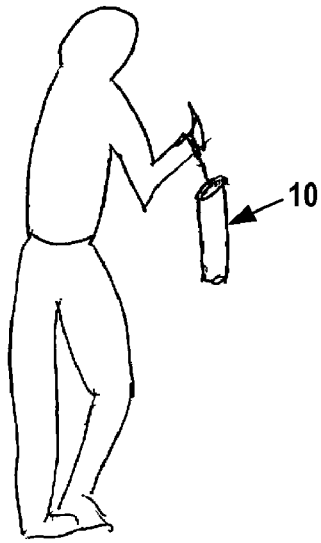
FIG. 8 illustrates a person carrying by hand the rolled-up stadium seat cushion.
Figure 9:
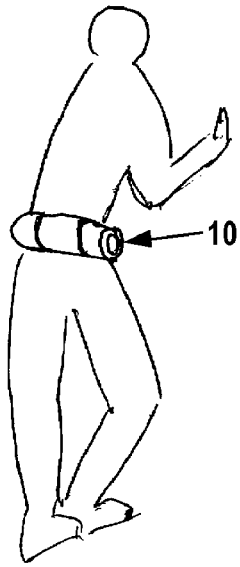
FIG. 9 illustrates the rolled-up stadium seat cushion attached to a person's belt for hands-free carrying of the stadium seat cushion.

FIGS. 8 and 9 illustrate the convenience of carrying the seat cushion 10 when the seat cushion is rolled up. The illustrated seat cushion 10 weighs about eight ounces, and is easily carried by one hand "umbrella style" as shown in FIG. 8. Alternatively the straps 32 can be looped through one's belt for carrying the roll in a hands-free "fanny-pack" style shown in FIG. 9.

While I have illustrated and described a preferred embodiment of my invention, it is understood that these are capable of modification, and I therefore do not wish to be limited to the precise details set forth, but desire to avail myself of such changes and alterations as fall within the purview of the following claims.

What I claim as my invention is:

1. A stadium seat cushion for use on either an individual stadium seat having a seat back, an end of a stadium bench seat, or an intermediate portion of the bench seat more than one seating position away from an end of the bench seat, the stadium seat cushion comprising:

a cushion portion having a first side, an opposite second side, and a cushion body between the first and second sides, the second side of the cushion portion having a first edge and second edge spaced from the first edge, the second edge adjacent the seat back when the stadium seat cushion is on the individual stadium seat;

a fabric piece and attachment structure fixedly attaching the fabric piece to the cushion portion, the attachment structure configured to nonremovably hold the fabric piece outside of the cushion portion with a portion of the fabric piece permanently overlying the second side of the cushion portion and not otherwise movable with respect to the cushion portion except for the inherent elasticity of the fabric piece;

the portion of the fabric piece overlying the second side of the cushion portion comprising an elastic portion, the fabric piece extending along the second side of the cushion portion from the elastic portion towards the first edge of the second side of the cushion portion, the elastic portion defining an enlargeable opening between the fabric piece and the second side of the cushion portion to receive an end of the individual seat or an end of a bench seat through the enlarged opening and between the fabric portion and the cushion portion for securing the seat cushion to the end of the individual seat or to the end of the bench seat; and an adjustable-length strap attached to the cushion portion, a portion of the strap fixedly fastened to the second side of the cushion portion, the remaining portion of the strap flexible and extendable away from the second side of the cushion portion to a free end portion of the strap, a first fastener member on the free end portion of the strap and a second fastener member connected to the second side of the cushion portion and disposed on the second side of the cushion portion, the second fastener located closer to the first edge than to the second edge of the second side of the seat cushion, the fasteners releasably engageable with one another on the second side of the cushion portion to form an adjustably-sized loop from said strap and engaged fasteners that extends away from the second side of the cushion portion, the strap having sufficient length to form a loop that can extend around an intermediate portion of the bench seat to hold the second side of the cushion portion in an abutting relationship against an intermediate portion of the bench seat.

2. The stadium seat cushion of claim 1 wherein the strap represents a first strap webbing and the cushion comprises a second strap webbing attached to the second side of the cushion portion and extendable away from the one second side of the cushion portion, the second fastening member attached to a free end portion of the second strap webbing.

3. The stadium seat cushion of claim 2 wherein the second fastener member is movable through said enlargeable opening, whereby the second fastener member can be stored between the fabric portion and the cushion portion when not in use and can be removed from between the fabric portion and the cushion portion when in use.

4. The stadium seat cushion of claim 1 wherein the attachment structure comprises a sewn connection between the other three sides of the fabric piece and the cushion portion.

5. The stadium seat cushion of claim 1 wherein the elastic portion of the fabric piece comprises a hem and an elastic cord in the hem.

6. The stadium seat cushion of claim 1 wherein the fabric portion overlays less than the all of the second side of the cushion portion.

7. The stadium seat cushion of claim 1 comprising a pouch on the first side of the cushion portion, the pouch having an opening accessible from the outside of the seat cushion.

8. The stadium seat cushion of claim 7 comprising a heating element in the pouch.

9. The stadium seat cushion of claim 1 wherein the portion of the fabric piece overlying the second side of the cushion portion extends from the elastic portion completely to the edge of the second side of the cushion portion.

10. The stadium seat cushion of claim 1 wherein the portion of the fabric piece overlying the second side of the cushion portion comprises an edge spaced away from the edge of the second side of the cushion portion, and the elastic portion is located at the edge of the fabric piece.

* * * * *